US005609017A

United States Patent [19]

Althaus

[11] Patent Number: 5,609,017

[45] Date of Patent: Mar. 11, 1997

[54] METHOD AND APPARATUS FOR OPERATING A COMBUSTION CHAMBER FOR AUTOIGNITION OF A FUEL

[75] Inventor: Rolf Althaus, Kobe, Japan

[73] Assignee: ABB Management AG, Baden, Switzerland

[21] Appl. No.: 427,590

[22] Filed: Apr. 24, 1995

[30] Foreign Application Priority Data

May 19, 1994 [DE] Germany ..... 44 17 536.1

[51] Int. Cl.[6] ..... F23C 5/08

[52] U.S. Cl. ..... 60/39.06; 60/737

[58] Field of Search ..... 60/39.06, 725, 60/737, 739, 747, 748, 749

[56] References Cited

U.S. PATENT DOCUMENTS

| | | | |
|---|---|---|---|
| 2,716,863 | 9/1955 | Reingold et al. | 60/737 |
| 3,691,762 | 9/1972 | Ryberg et al. | 60/737 |
| 3,958,416 | 5/1976 | Hammond, Jr. et al. | 60/739 |
| 4,215,535 | 8/1980 | Lewis | 60/739 |
| 4,246,757 | 1/1981 | Heberling | 60/737 |
| 4,373,325 | 2/1983 | Shekleton | 60/39.06 |
| 5,263,325 | 11/1993 | Mc Vey et al. | 60/739 |
| 5,343,693 | 9/1994 | Komatsu et al. | 60/737 |
| 5,475,979 | 12/1995 | Oag et al. | 60/747 |
| 5,487,274 | 1/1996 | Gulati et al. | 60/725 |

FOREIGN PATENT DOCUMENTS

| | | |
|---|---|---|
| 0321809A1 | 6/1989 | European Pat. Off. . |
| 2-21118 | 1/1990 | Japan . |

*Primary Examiner*—Timothy S. Thorpe

*Attorney, Agent, or Firm*—Burns, Doane, Swecker & Mathis, L.L.P.

[57] ABSTRACT

A method and apparatus for operating a combustion chamber for autoignition of a fuel includes spraying fuel into a hot gas through a plurality of fuel lances disposed in a mixing zone of a combustion chamber for autoignition of the fuel. The fuel lances are supplied with fuel as two individually supplied groups. Fuel is supplied first to a first group of lances and increased to reach an intermediate operating temperature of about 1100° C. The fuel supply to the second group is then activated, and the fuel supply increased to reach the same intermediate operating temperature with the second group. After both groups are operating at the intermediate temperature, the fuel supply to both groups is simultaneously increased to reach the operating temperature of the combustion chamber.

5 Claims, 2 Drawing Sheets

METHOD AND APPARATUS FOR OPERATING A COMBUSTION CHAMBER FOR AUTOIGNITION OF A FUEL

BACKGROUND OF THE INVENTION

The present invention relates to a method for operating a combustion chamber for autoignition of a fuel. It also relates to a combustion chamber for carrying out the method.

DISCUSSION OF BACKGROUND

In burner configurations with a premixing zone and with an outlet open to the downstream combustion space in the flow-off direction, the problem repeatedly arises of how a stable flamefront, along with extremely low emission values, can be brought about in the simplest possible way. Various inherently unsatisfactory proposals have already become known in this regard. On exception which has become known hitherto is the invention which is disclosed in U.S. Pat. No. 4,932,861 to Keller et al and in which the proposals regarding flame stabilization, efficiency and emissions of harmful substances constitute a leap forward in terms of quality.

A typical firing plant, in which said techniques are bound to fail in the face of a flame flashback, relates to a combustion chamber designed for auto-ignition. This is, as a rule, an essentially cylindrical tube or an annular combustion chamber, into which a working gas flows at a relatively high temperature from approximately 850° C., and there the formation of an auto-igniting mixture is initiated by means of a sprayed-in fuel. The caloric treatment of the working gas into hot gas takes place solely within this tube or this annular combustion chamber. If it is a postcombustion chamber taking effect between a high-pressure and a low-pressure turbine, then it is impossible, if only for reasons of space, to install a premixing zone or premixing burner and to provide or install aids against a flame flashback, which is why this inherently attractive combustion technique has hitherto had to be relinquished. If the assumption is to provide an annular combustion chamber as a postcombustion chamber of a gas-turbine group mounted on a single shaft, then additional problems arise with regard to minimizing the length of this combustion chamber which are related to flame stabilization. However, even if the solution for flame stabilization is satisfactory, the initial yield of various emissions of harmful substances is still not yet solved. The critical range is between the autoignition act and a temperature of approximately 1100° C. In this range, high emissions, particularly in the form of CO and UHC, are produced, and these no longer comply with the legislation of many countries. Only when the combustion temperature is higher than 1100° C. is it possible to have a good burn-up along with minimized emissions of harmful substances.

SUMMARY OF THE INVENTION

The invention is intended to remedy this. The object on which the invention, as defined in the claims, is based is, in a method and a combustion chamber of the type initially mentioned, to minimize particularly the CO and UHC emissions in the critical range between auto-ignition and a temperature of approximately 1100° C.

It is proposed to lower the emissions of harmful substances by putting the existing burners into operation in steps. For this purpose, the burners are to be divided into at least two groups. The individual groups are run up successively in series from the auto-ignition point to at least 1100° C.

The essential advantage of the invention is to be seen in that, as a result of the serial run-up into a subcritical domain, the load range characterized by high emission values of harmful substances, particularly with regard to CO and UHC emission values (UHC=unsaturated hydrocarbons), can be significantly bridged. The group of burners which is used is supplied, on average, with a larger quantity of fuel during the starting phase; the individual burners can thus be operated more stably. When all the burner groups have been brought up to a temperature step of approximately 1100° C. they are subsequently run up from this temperature step in parallel to the desired operating temperature.

Advantageous and expedient developments of the set object according to the invention are defined in the further dependent claims.

An exemplary embodiment of the invention is explained in more detail below by means of the drawings. All elements not necessary for an immediate understanding of the invention are omitted. Like elements are provided with the same reference symbols in the various figures. The direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
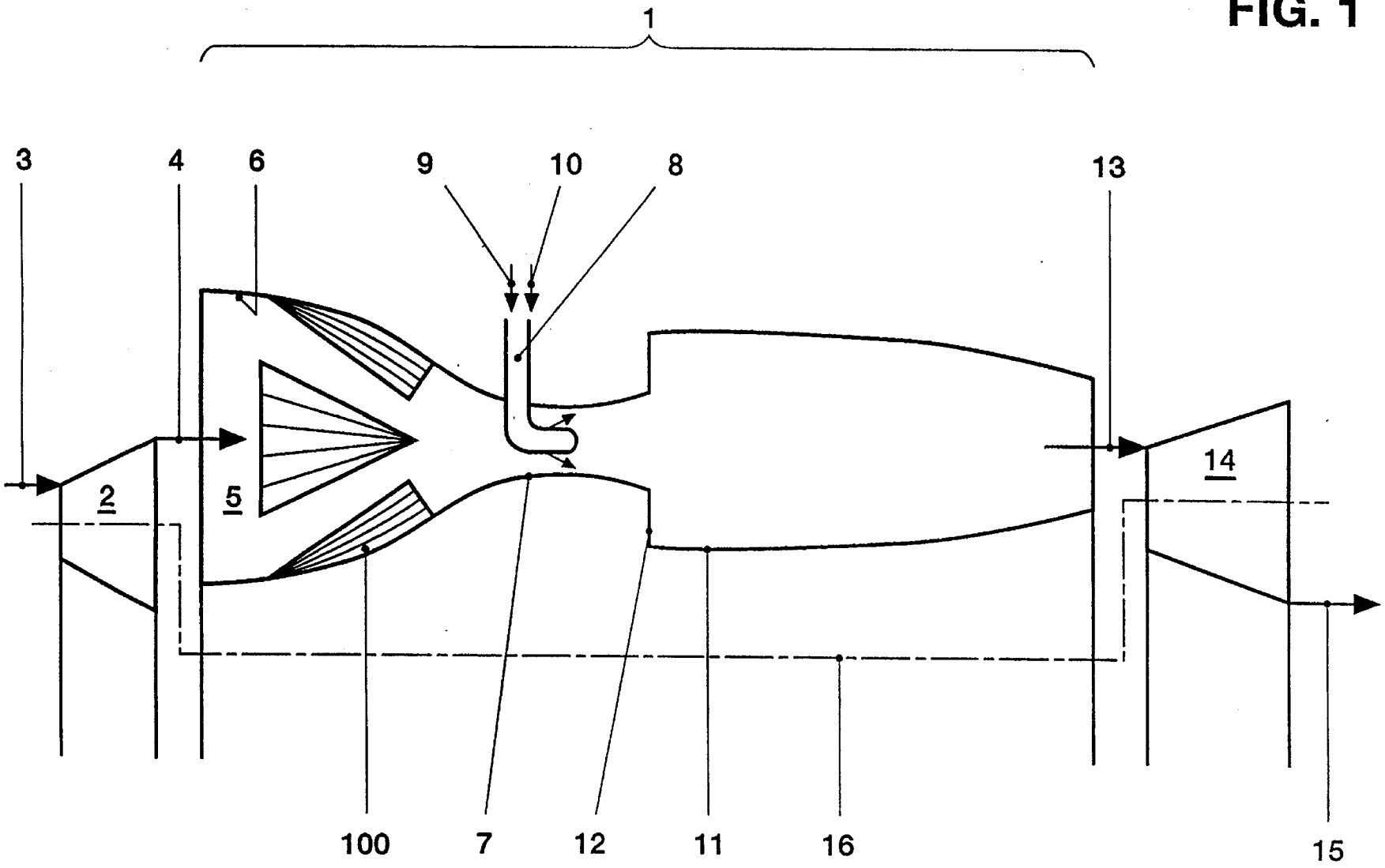
FIG. 1 shows an auto-igniting combustion chamber designed as an annular combustion chamber.

Referring now to the drawings, wherein like reference numerals designate identical or corresponding parts throughout the several views, in FIG. 1 there is, as emerges from the shaft axis 16, an annular combustion chamber 1 which has essentially the form of a continuous annular or quasi-annular cylinder. Furthermore, such a combustion chamber can also consist of a number of axially, quasi-axially or helically arranged and individually self-contained combustion spaces. Such annular combustion chambers are preeminently suitable to be operated as auto-igniting combustion chambers which are placed in the direction of flow between two turbines mounted on a shaft. When such an annular combustion chamber 1 is operated by auto-ignition, the turbine 2 acting upstream is designed only for a part expansion of the hot gases 3, as a result of which the exhaust gases 4 downstream of this turbine 2 still flow at a very high temperature into the inflow zone 5 of the annular combustion chamber 1. This inflow zone 5 is equipped on the inside and in the circumferential direction of the channel wall 6 with a row of vortex-generating elements 100, referred to below only as vortex generators. The exhaust gases 4 are swirled by the vortex generators 100 in such a way that, in the downstream premixing zone 7, no recirculation areas occur in the wake of said vortex generators 100.

Arranged in the circumferential direction of this premixing zone 7 designed as a Venturi channel are a plurality of fuel lances 8 which take over the supply of a fuel 9 and of a supporting air 10. These fuel lances 8 will be discussed in more detail further below. The supply of these media to the individual fuel lances 8 can be carried out, for example, via a ring conduit (not shown). The swirl flow initiated by the vortex generators 100 ensures a large-volume distribution of the fuel 9 introduced, at best also of the admixed supporting air 10. Furthermore, the swirl flow ensures a homogenization of the mixture of combustion air and fuel. The fuel 9 sprayed into the exhaust gases 4 by the fuel lance 8 initiates auto-ignition, insofar as these exhaust gases 4 have that specific temperature which can initiate the fuel-dependent auto-ignition. If the annular combustion chamber 1 is operated with a gaseous fuel, a temperature of the exhaust gases 4 from approximately 850° C. must be present for the initiation of auto-ignition. As already acknowledged above, with such combustion, there is the inherent risk of a flame flashback. This problem is overcome on the one hand by designing the premixing zone 7 as a Venturi channel and on the other hand by arranging the spray-in of the fuel 9 in the region of the greatest contraction within the premixing zone 7. As a result of the narrowing in the premixing zone 7, the turbulence is reduced because the axial velocity is increased, the risk of flashback being minimized on account of the reduction in the turbulent flame velocity. On the other hand, the large-volume distribution of the fuel 9 continues to be guaranteed, since the circumferential component of the swirl flow originating from the vortex generators 100 is not impaired. The premixing zone 7, which is kept relatively short, is followed downstream by a combustion zone 11. The transition between the two zones is formed by a radial cross-sectional jump 12 which initially induces the through-flow cross section of the combustion zone 11. A flamefront is also established in the plane of the cross-sectional jump 12. In order to prevent the flame from flashing back into the interior of the premixing zone 7, the flamefront must be kept stable. For this purpose, the vortex generators 100 are designed so that no recirculation yet takes place in the premixing zone 7; only after the sudden cross-sectional widening is it desirable for the swirl flow to burst open. The swirl flow assists the rapid repositioning of the flow behind the cross-sectional jump 12, so that a high burn-up, along with a short overall length, can be achieved because the volume of the combustion zone 11 is utilized as fully as possible. During operation, there forms within this cross-sectional jump 12 a flow boundary zone, in which the negative pressure prevailing there gives rise to the shedding of vortices which then leads to a stabilization of the flamefront. The exhaust gases 4 treated in the combustion zone 11 to form hot gases 14 subsequently load a further turbine 14 acting downstream. The exhaust gases 15 can subsequently be used to operate a steam circuit, in the last-mentioned case the plant then being a combination plant.

Figure 2:
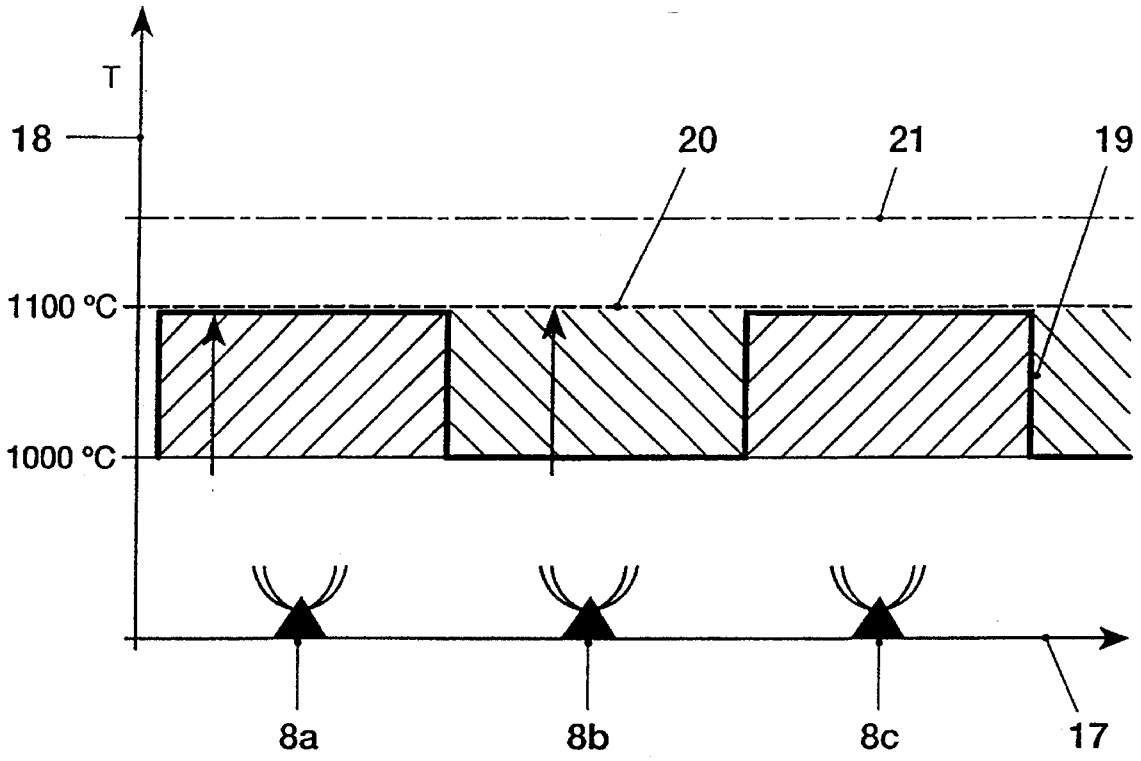
FIG. 2 shows a diagrammatically recorded stepped starting phase in the case of an autoigniting combustion chamber.

FIG. 2 shows a diagram, in which the stepped operating mode of the burners during the starting phase is evident. The abscissa 17 is intended to symbolize the layout of the burners arranged next to one another, whilst the ordinate 18 shows the first temperature steps approached during the starting phase. In the stepped operating mode, the burners, that is to say the fuel lances of FIG. 1, are supplied serially with fuel during the starting phase. In a first step 19, the fuel lances 8*a*, 8*c*, etc. are put into operation and are first brought to approximately 1100° C. Subsequently, in a two-step operating mode, the remaining fuel lances 8*b*, 8*d*, etc. are likewise brought to said temperature level of approximately 1100° C. As soon as all the burners have been brought to this new temperature step 20, they are then run up jointly, that is to say in parallel, to the desired operating-temperature step 21. Since the burners put into C) operation in steps are operated in each case with a larger quantity of fuel, it is possible to run through the range having high emission values with a richer mixture, as already mentioned above, with the result that the burners can initially be operated more stably. However, this operating mode has the additional advantage that particularly the CO and UHC emissions can be lowered significantly in the critical range between 1000° C. and 1100° C. The stepped operating mode during the starting phase is not restricted to 2 groups of burners.

Figure 3:
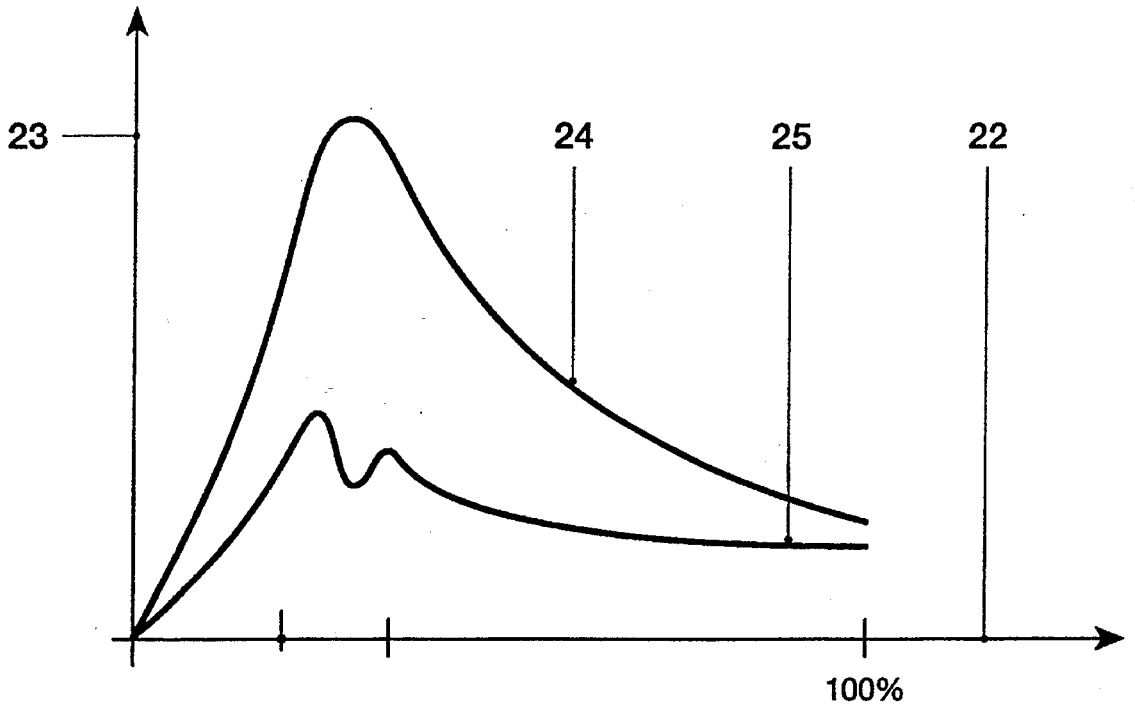
FIG. 3 shows a qualitative recording of the emission values for harmful substances between a non-stepped and a stepped operating mode during the starting phase in the case of an auto-igniting combustion chamber.

FIG. 3 shows a qualitative comparison relating to the emissions of harmful substances between a non-stepped and a stepped operating mode. In the diagram, the abscissa 22 shows the load range, zero being that temperature level at which the auto-ignition of the mixture takes place, that is to say, in this case, from approximately 850° C. The ordinate 23 shows the degree of emissions of harmful substances. The curve 24 shows the trend of the emissions of harmful substances in the case of a conventional non-stepped operating mode. The peak symbolizes the CO and UHC yield in the interval between approximately 1000° C. and approximately 1100° C. The stepped operating mode is different, as shown by the curve 25. A two-hump trend, corresponding to the stepped operating mode with two burner groups, can be seen here. In terms of order of magnitude, with the stepped operating mode, emissions which are less than half those of the conventional operating mode can be achieved.

Obviously, numerous modifications and variations of the present invention are possible in light of the above teachings. It is therefore to be understood that, within the scope of the appended claims, the invention may be practiced otherwise than as specifically described herein.

What is claimed:

1. A method for operating a combustion chamber, comprising the steps of:

guiding a hot gas having a temperature sufficient to initiate auto-ignition of a fuel into a combustion space, spraying a fuel into the hot gas via a plurality of fuel lances, wherein the fuel lances are connected for fuel supply in at least two separately controllable groups, wherein during start up of the combustion chamber, spraying the fuel comprises the steps of:

supplying fuel first to a first group and increasing the fuel to reach a temperature of about 1100° C., supplying fuel in addition to the first group to a second group and increasing the fuel to reach a temperature of about 1100° C., and when the at least two groups are operating at about 1100° C., increasing the fuel to all the fuel lances to reach an operating temperature.

2. The method as claimed in claim 1, wherein the fuel lances are supplied with fuel and supporting air.

3. A combustion chamber for autoignition of a fuel, comprising:

an inflow zone to receive a main flow of hot gas, the inflow zone enclosed by a peripheral wall;

a plurality of vortex generators mounted on the peripheral wall of the inflow zone to create vortices in the main flow;

a premixing passage connected to receive the main flow from the inflow zone;

a plurality of fuel lances disposed for spraying fuel into the premixing zone; and a combustion zone bounded by a wall and connected to receive the main flow with injected fuel from the premixing passage, wherein the wall of the combustion zone connecting to an outlet of the premixing passage has a radially extending portion forming a cross-section expanding jump.

4. The combustion chamber as claimed in claim 3, further comprising means for supplying fuel to the fuel lances as at least two individually supplied groups.

5. The combustion chamber as claimed in claim 3, wherein the premixing passage is a Venturi-shaped channel.

* * * * *